United States Patent [19]

Honegger

[11] 4,201,377

[45] May 6, 1980

[54] CONVEYOR SYSTEM HAVING A LATERAL TAKE-OFF CONVEYOR FOR FLAT PRODUCTS, ESPECIALLY PAPER PRODUCTS

[75] Inventor: Werner Honegger, Tann-Ruti, Switzerland

[73] Assignee: Ferag AG, Hinwil, Switzerland

[21] Appl. No.: 908,013

[22] Filed: May 22, 1978

[30] Foreign Application Priority Data

May 27, 1977 [CH] Switzerland ..... 6530/77

[51] Int. Cl.[2] ..... B65H 5/00

[52] U.S. Cl. ..... 271/225; 271/184; 271/248; 271/253

[58] Field of Search ..... 271/184, 225, 248, 253

[56] References Cited

U.S. PATENT DOCUMENTS

| | | | |
|---|---|---|---|
| 1,295,123 | 2/1919 | Cheshire | 271/184 |
| 2,639,772 | 5/1953 | Sandberg | 271/225 X |
| 3,658,322 | 4/1972 | Martin | 271/184 |
| 3,880,420 | 4/1975 | Martin | 271/184 |
| 3,912,258 | 10/1975 | Martin | 271/184 |

*Primary Examiner*—Richard A. Schacher
*Attorney, Agent, or Firm*—Werner W. Kleeman

[57] ABSTRACT

A cornering conveyor, meaning a conveying enabling infeed of products in one direction and outfeed thereof in another direction, usually but not exclusively, essentially at right angles to one another. The conveyor or conveyor system of the invention comprises an infeed conveyor and an outfeed conveyor which travels past the discharge end of the infeed conveyor and at an angle with regard to its direction of conveying of the products or the like. The outfeed conveyor operatively has associated therewith essentially conical clamping bodies mounted to be rotatable about their related axis and arranged in succession in the direction of conveying of the outfeed conveyor and in spaced relationship from the discharge end of the infeed conveyor. The tips of the clamping bodies are directed towards the conveying direction of the infeed conveyor. The outer surfaces of the clamping bodies together with the outfeed conveyor form a respective conveyor or conveying gap which is effective in the conveying direction of the outfeed conveyor. In order that the cornering conveyor or conveyor system is also suitable for handling products arriving at the infeed conveyor in an imbricated product stream, the spacing of the successive clamping bodies increases from the discharge end of the infeed conveyor in the conveying direction of the outfeed conveyor.

8 Claims, 3 Drawing Figures

CONVEYOR SYSTEM HAVING A LATERAL TAKE-OFF CONVEYOR FOR FLAT PRODUCTS, ESPECIALLY PAPER PRODUCTS

BACKGROUND OF THE INVENTION

The present invention relates to a new and improved construction of material handling apparatus and, more specifically, deals with a new and improved cornering conveyor system i.e., a conveyor system having a lateral take-off conveyor, for flat products or the like, especially paper products.

The cornering conveyor system of the present development is of the type comprising an infeed conveyor and an outfeed conveyor, the outfeed conveyor moves past the discharge end or portion of the infeed conveyor and at an angle with regard to its conveying direction. Further, essentially conical clamping bodies rotatable about their related axis are provided for the outfeed conveyor, these clamping bodies being arranged successively in the direction of conveying of the outfeed conveyor and at a spacing from the discharge end of the infeed conveyor. The clamping bodies have tips directed towards the conveying direction of the infeed conveyor and their outer or jacket surface together with the outfeed conveyor form a respective conveyor or conveying gap effective in the direction of conveying of the outfeed conveyor.

Now in U.S. Pat. No. 3,880,420 and U.S. Pat. No. 3,912,258, especially FIGS. 1, 4 and 5, there is disclosed such general type of outfeed conveyor. With this state-of-the-art so-called cornering conveyor the infeed conveyor is constructed as a small band conveyor and the outfeed conveyor is constructed as a roll track moving away from the infeed conveyor and at right angles thereto. The outfeed conveyor has operatively associated therewith a set of conical, rotatable clamping bodies which in the direction of conveying of the roll track are arranged in succession in a row parallel to its conveying direction. During operation, the outer surfaces of these clamping bodies together with the neighboring rolls of the outfeed conveyor form a conveyor gap where there are clamped the products arriving from the infeed conveyor, and thus, without any change in position transport away these products transverse to the direction of conveying of the infeed conveyor. A prerequisite for a faultless mode of operation of the thus constructed corner conveyor is, however, that the products are infed thereto individually, or, however, in individual rows. In the case of products which already are available at the infeed conveyor in a practically endless, imbricated formation, where successive products partially overlap one another, especially printed prodcuts arriving from a rotary printing press, this prior art cornering conveyor is however not suitable for use.

SUMMARY OF THE INVENTION

Hence, with the foregoing in mind, it is a primary object of the present invention to provide a new and improved construction of a cornering conveyor system of the previously mentioned character which is not associated with the aforementioned drawbacks and limitations of the prior art proposals discussed above.

Another and more specific object of the present invention aims at providing a new and improved construction of a cornering conveyor of the previously mentioned type which is designed such that an imbricated stream of products arriving at the infeed device or conveyor can be transferred continuously into a new imbricated stream of products at the outfeed device or outfeed conveyor, without having to turn the individual products.

Still a further significant object of the present invention aims at the provision of a new and improved conveyor system for handling products, especially printed products, in an extremely reliable, efficient and accurate manner, which appartus is relatively simple in construction and design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the cornering conveyor of the present development is manifested by the features that, viewed in the conveying direction of the outfeed conveyor, the spacing of the successive clamping bodies increases from the outfeed or discharge end of the infeed conveyor.

By virtue of the foregoing measures there is realized the beneficial result that the size of the conveyor gaps increase in a plane intersecting at right angles the direction of conveying of the infeed conveyor, and thus, the inclined position of the products is taken into account at the new imbricated product stream which is formed at the outfeed conveyor. The products in the new imbricated product stream which are formed at the outfeed conveyor therefore do not have any possibility of fanning or spreading out, and thus, remain in an aligned state at the outfeed conveyor.

Features of preferred exemplary embodiments of the proposed cornering conveyor, especially measures which serve to simplify the conversion of the cornering conveyor when handling products of a different format or shape, or for the automatic accommodation to the thickness of the arriving products and the arriving imbricated product stream, will be apparent from the description to follow and the claimed subject matter.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 3:
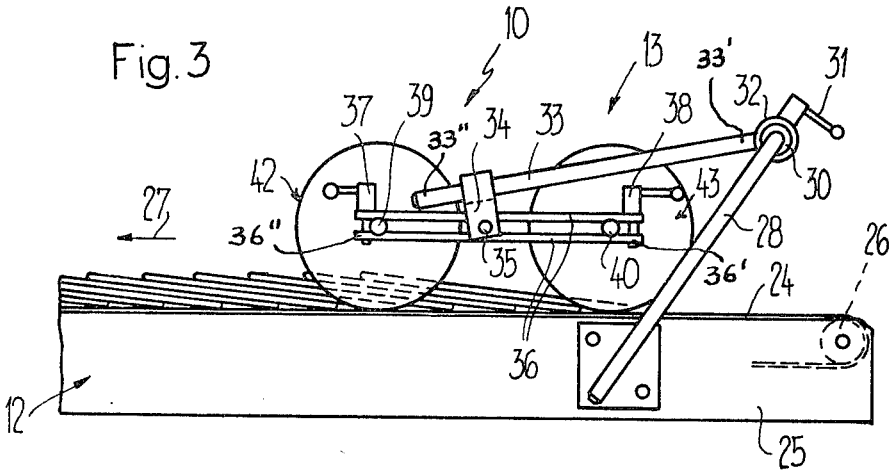
FIG. 3 is a side fragmentary view of the cornering conveyor system of FIG. 1, viewed opposite to the direction of conveying of the infeed conveyor, wherein however such has been omitted to preserve clarity in illustration.
Figure 1:
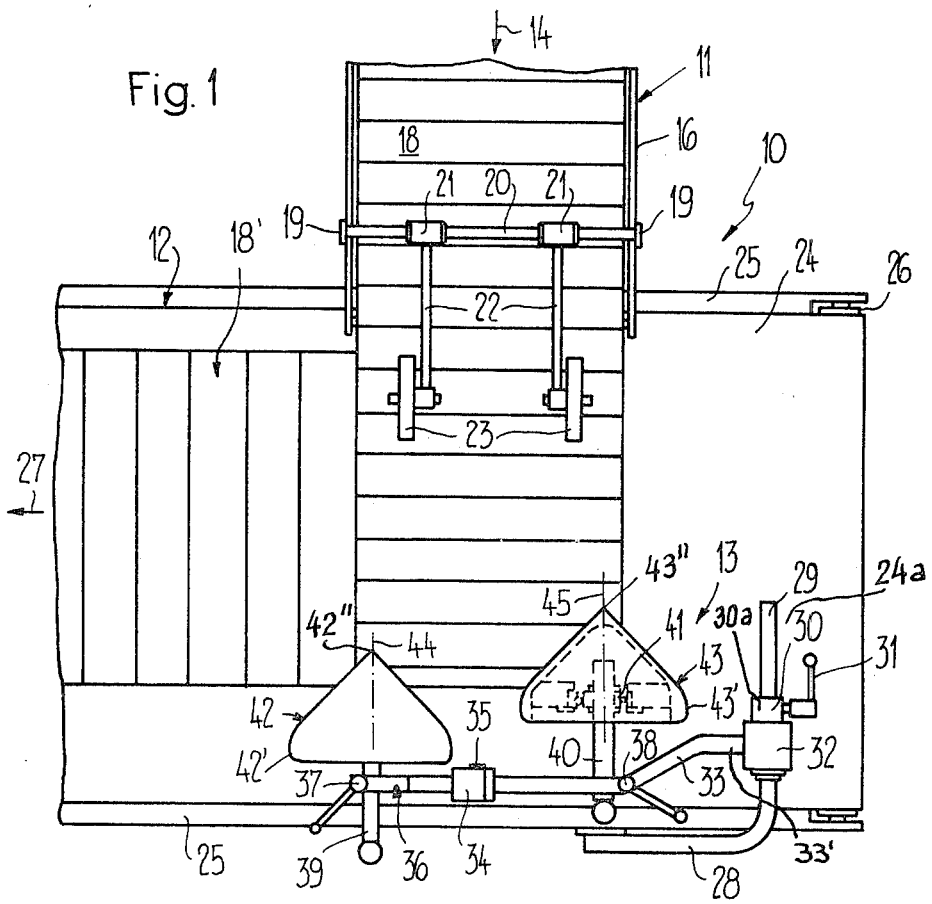
FIG. 1 is a fragmentary top plan view of a cornering conveyor i.e., a conveyor system having a lateral take-off conveyor, constructed according to the teachings of the present invention.
Figure 2:
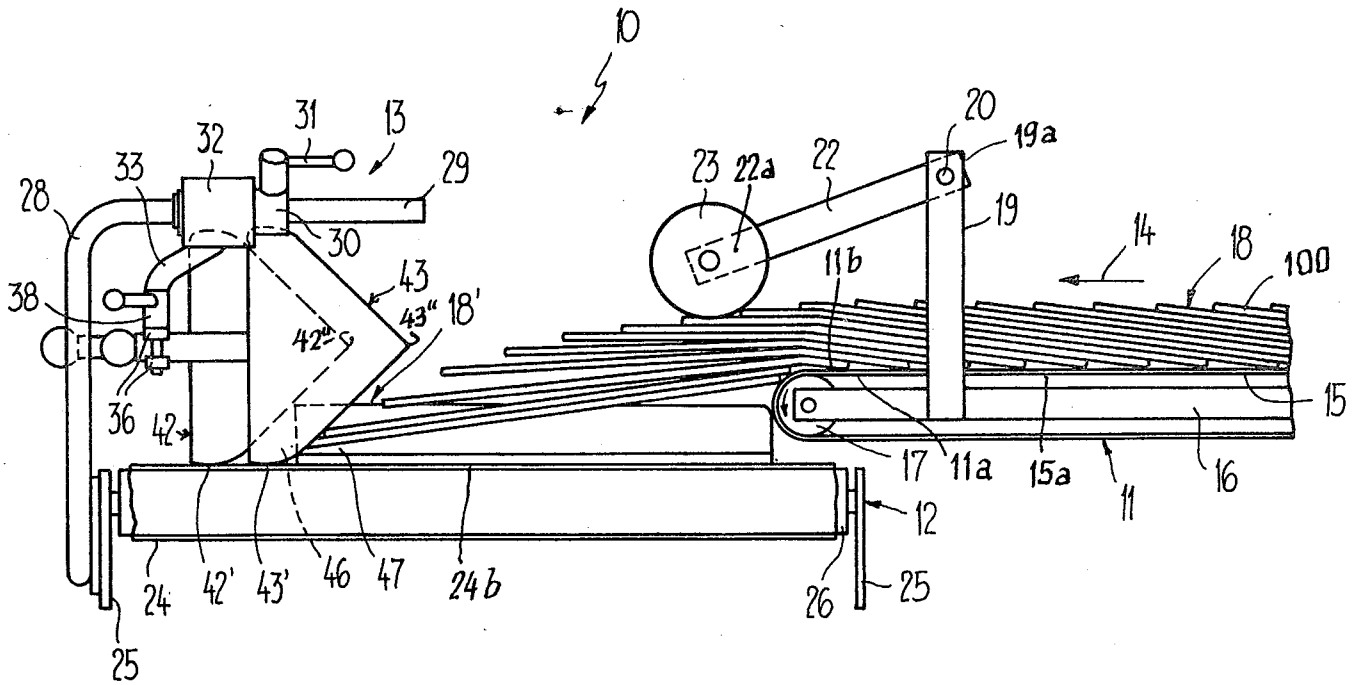
FIG. 2 is a side fragmentary view of the cornering conveyor system or cornering conveyor shown in FIG. 1 looking in the direction of conveying of the outfeed conveyor.

Describing now the drawings, the cornering conveyor system 10 shown by way of example in FIGS. 1 to 3 will be seen to comprise an infeed device, shown as an infeed conveyor 11, an outfeed device, shown as an outfeed coneyor 12 and a deflection mechanism 13. The infeed conveyor or device 11 formed by a conveyor belt or band 15 driven in any suitable manner, by for instance a not particularly shown drive in the direction of the arrow 14, terminates at a deflection roll 17 which is rotatably mounted in a frame 16. The terminal portion 11*a* of the infeed conveyor 11 thus constitutes the discharge end or region 11*b* of such infeed conveyor 11. The upper run 15*a* of the conveyor band 15 supports in free bearing contact the articles being handled, here in the form of printed products, generally indicated by reference character 100, these printed products arriving in an imbricated product stream 18. Attached at a frame 16 to both sides of the conveyor band or belt 15 are the overhang arms or cantilevers 19, the free ends 19*a* of which (FIG. 2) are interconnected by a rod or crosstie 20. This arrangement is accomplished such that the cantilevers or overhang arms 19 which extend upwardly from the sides of the conveyor band 15 and the interconnecting rod 20 span the conveyor belt or band 15 in a gantry-like fashion. Now at the rod 20 there is articulated at, for instance, two locations defining the hinge points or hinge means 21 a respective rocker arm or rocker member 22, at the respective free end 22*a* of which there is mounted a related freely rotatable roll or roller 23. Each such roll or roller 23 bears under the action of its inherent weight against the imbricated product stream and rolls thereon at a location which, viewed in the direction of conveying 14 of the infeed conveyor 11, is located downstream with regard to the deflection roll 17. Hence, the incoming imbricated product stream 18, at the moment of departing from the discharge end 11*b* of the infeed conveyor 11 is held together, and furthermore, forced onto the outfeed conveyor 12 which moves therepast below the roll 17.

The outfeed conveyor 12 will be seen to comprise a conveyor band or belt 24 which is guided, at the end shown, about a roll 26 rotatably mounted in a frame 25 and driven, again by any suitable drive means (not shown) in the direction of the arrow 27. Further, from FIGS. 1 and 2 it will be apparent that the conveying direction of the infeed conveyor 11 is at right angles to that of the outfeed conveyor 12, and that the infeed conveyor 11 terminates at one side of the outfeed conveyor 12. Thus, the term cornering conveyor system as used herein is intended to encompass a conveyor system for products wherein there is provided a lateral take-off conveyor, here constituted by the outfeed conveyor 12.

Continuing, at the frame 25 there is attached one end of a substantially L-shaped overhang arm or cantilever 28 which engages by means of its leg 29 over the starting portion 24*a* of the upper run 24*b* of the conveyor band 24. At the leg 29 there is mounted a bushing or sleeve 30 which is displaceably arranged for movement on such leg 29. This displaceable bushing of sleeve 30 can be positionally fixed by means of a clamping lever 31 or some other suitable clamping expedient, such as a clamping screw, in desired position along the leg 29. The outer surface 30*a* of the bushing or sleeve 30 serves as a bearing journal for a bearing eyelet 32 which is freely rotatable upon the bushing 30 but not lengthwise displaceable thereof. Now at the bearing eyelet 32 there is attached one end 33' of a rocker element or balance 33, the other end 33'' of which is articulated by means of a hinge element 34 and a pivot pin 35 at a beam 36 structured like a double-arm balance beam. At the ends 36'' and 36' of the beam 36 there is fixedly clamped by means of a clamping screw 37 and 38 a respective pin 39 and 40, in a manner such that the pins 39 and 40, following loosening of the related clamping screw 37 and 38 respectively, can be individually shifted in lengthwise direction. Upon each of the pins 39 and 40 there is freely rotatably mounted, for instance, by means of a ball bearing 41 shown in phantom lines at the right of the illustration of FIG. 1, a substantially conical or bulbous clamping body 42 and 43 for rotation about their own respective lengthwise axis 44 and 45. Further, the tip or apex 42'' and 43'' of these clamping bodies 42 and 43, respectively, are directed towards i.e., opposite the conveying direction 14 of the infeed conveyor 11. It should be understood that the mounting of the conical clamping bodies 42 and 43 can be of random construction, as long as these clamping bodies are free to rotate about their own lengthwise axis. In the embodiment under discussion, given by way of example, the lengthwise axes 44 and 45 of the clamping bodies 42 and 43 are shown parallel to the conveying direction 14 of the infeed conveyor or infeed device 11 and situated close to the respective plane containing the related lateral edge or side of the infeed conveyor 11. However, they also could be somewhat inclined with regard to such conveying direction 14.

Reverting again to FIGS. 1 and 2, it will be seen that the generatrix of the conical or bulbous bodies 42 and 43 is convex at the region of their base circle, so that the conical bodies 42 and 43 at the region of their base circle practically have a cylindrical section or portion 42' and 43', respectively, constituting the largest diameter part of the bodies 42 and 43 and each of which bears upon the conveyor band or belt 24. Accordingly, the conical bodies 42 and 43 are directly driven by the conveyor band or belt 24, and in conjunction therewith, they form a respective conveyor or conveying gap 46 and 47 which operates in the same sense as the outfeed conveyor or outfeed device 12. These conveyor gaps 46 and 47 will be seen to taper or narrow in the conveying direction 14 of the infeed device or infeed conveyor 11.

The imbricated product stream 18 present at the infeed conveyor 11 is transformed at the outfeed conveyor 12 into a new imbricated product stream 18'. The thickness of an imbricated product stream is not only dependent upon the thickness of the individual printed products 100, rather also upon the spacing of the printed products which follow one another in succession within the imbricated product stream, this spacing, again, depending upon the conveyor speed. At the conveyor band 24 there thus is formed the new imbricated product stream 18', the thickness of which also depends upon the velocity or speed of movement of the conveyor band 24. In the conveyor gap 47 formed between the clamping body 43 and the conveyor band or belt 24, and as best seen by referring to FIGS. 1 and 2, there only arrive the leading, left edges—viewed in the direction 14—of the less thicker printed products, and such thereafter soon depart from such conveyor gap 47. On the other hand, the conveyor gap 46 receives the imbricated product stream 18' forming at the conveyor band 24 in its entire thickness. In order to be able to accommodate the increasing thickness of the imbricated product stream 18', the clamping body 42 is arranged offset or rearwardly set with regard to the clamping body 43, as shown.

Due to the adjustability of the rocker means or rocker arrangement 33 in the direction of the infeed conveyor 11 it is therefore possible to take into account the specific shape or format of the arriving printed products 100, and due to the axial individual adjustability of the conical clamping bodies 42 and 43 with regard to one another it is possible to take into account the thickness of the individual printed products as well as the thickness of the imbricated product stream 18' forming upon the conveyor band 24.

Tests have shown that for comparatively thin printed products it is adequate to use only a single conical clamping body, in order to produce an orderly imbricated product stream at the conveyor band 24 where the printed products are aligned relative to one another.

It is not absolutely mandatory that the clamping bodies 42 and 43 be directly driven, as here directly by the conveyor band 24. They can also be indirectly driven by the printed products 100 of the forming imbricated product stream 18'. What is only important is that the deflection mechanism 13, formed by both of the clamping bodies 42 and 43, acts somewhat in the manner of a deflection stop or impact which moves along in the conveying direction of the outfeed conveyor 12, which eliminates or annihilates the movement components of the individual printed products always at the same location and brought about by the infeed conveyor 11, so that the imbricated product stream 18 remains in an aligned state right from the start.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A conveyor system for substantially flat products, especially paper products, comprising:

an infeed conveyor for conveying the products in a first predetermined direction of travel;

said infeed conveyor having a discharge end;

an outfeed conveyor for conveying the products in a second predetermined direction of travel;

said outfeed conveyor traveling past the discharge end of the infeed conveyor and at an angle with regard to said first predetermined direction of conveying of the products;

a number of essentially conical clamping bodies each having a lengthwise axis and operatively associated with said outfeed conveyor;

means for mounting said essentially conical clamping bodies to be rotatable about their related lengthwise axis;

said mounting means arranging said essentially conical clamping bodies in succession in the second direction of conveying of the outfeed conveyor and in spaced relationship from the discharge end of the infeed conveyor;

each of said clamping bodies having a tip directed towards the direction of conveying of the infeed conveyor;

each of said clamping bodies having an outer surface;

said outer surfaces of said clamping bodies together with the outfeed conveyor forming a respective product conveying gap which is effective in the second direction of conveying of the outfeed conveyor; and the spacing of the successive clamping bodies increasing from the discharge end of the infeed conveyor in the conveying direction of the outfeed conveyor, said spacing being measured in a plane parallel to the conveying direction of and perpendicular to the plane of the outfeed conveyor.

2. The conveyor system as defined in claim 1, wherein:

each of said essentially conical clamping bodies has a region of largest diameter which frictionally bears at the outfeed conveyor and is thereby driven by such outfeed conveyor.

3. The conveyor system as defined in claim 1, wherein:

said mounting means for said clamping bodies incorporates mechanism for adjusting the clamping bodies in the direction of their axes and fixedly positioning the thus adjusted clamping bodies, so that the increase of the spacing from the discharge end of the infeed conveyor in the second direction of conveying of the outfeed conveyor can be altered.

4. A conveyor system for substantially flat products, especially paper products, comprising:

an infeed conveyor for conveying the products in a first predetermined direction of travel;

said infeed conveyor having a discharge end;

an outfeed conveyor for conveying the products in a second predetermined direction of travel;

said outfeed conveyor traveling past the discharge end of the infeed conveyor and at an angle with regard to said first predetermined direction of conveying of the products;

a number of essentially conical clamping bodies each having a lengthwise axis and operatively associated with said outfeed conveyor;

means for mounting said essentially conical clamping bodies to be rotatable about their related lengthwise axis;

said mounting means arranging said essentially conical clamping bodies in succession in the second direction of conveying of the outfeed conveyor and in spaced relationship from the discharge end of the infeed conveyor;

each of said clamping bodies having a tip directed towards the direction of conveying of the infeed conveyor;

each of said clamping bodies having an outer surface;

said outer surfaces of said clamping bodies together with the outfeed conveyor forming a respective product conveying gap which is effective in the second direction of conveying of the outfeed conveyor;

the spacing of the successive clamping bodies increasing from the discharge end of the infeed conveyor in the conveying direction of the outfeed conveyor;

said plurality of essentially conical clamping bodies including two substantially axially parallel clamping bodies;

balance beam means;

means for oscillatingly suspending said balance beam means about an axis extending essentially parallel to the first direction of conveying of the infeed conveyor;

said balance beam means having end portions; and one respective clamping body being mounted at each said end portion of said balance beam means.

5. The conveyor system as defined in claim 4, wherein:

said infeed conveyor has lateral oppositely situated edges; and each clamping body of said two clamping bodies being aligned with their related lengthwise axis essentially in the direction of a related one of the lateral edges of the infeed conveyor.

6. The conveyor system as defined in claim 4, further including:

means for adjusting and fixing in adjusted position the balance beam means in the first direction of conveying of the infeed conveyor.

7. The conveyor system as defined in claim 4, further including:

rocker means having a first end and second end;

means for articulating said balance beam means between its end portions at the first end of said rocker means;

means defining a stationary overhang arm means;

means for hingedly connecting the other end of said rocker means at said stationary overhang arm means;

said means for articulating the balance beam means at the first end of the rocker means and the means for hingedly connecting the other end of said rocker means at said stationary overhang arm means comprise pivot means having axes extending essentially parallel to the lengthwise axes of the clamping bodies.

8. The conveyor system as defined in claim 7, wherein:

said means for hingedly connecting the second end of said rocker means at said stationary overhang arm means comprises pivot means; and means for displacing and fixing in position said pivot means at said overhang arm means in the first direction of conveying of the infeed conveyor.

* * * * *